US006748825B2

(12) United States Patent
Hsu

(10) Patent No.: US 6,748,825 B2
(45) Date of Patent: Jun. 15, 2004

(54) ONE-WAY WRENCH

(76) Inventor: Yung-Chung Hsu, 13F, No. 27, Lane 93, Liu Yang West Street, Taichung (TW)

( * ) Notice: Subject to any disclaimer, the term of this patent is extended or adjusted under 35 U.S.C. 154(b) by 10 days.

(21) Appl. No.: 10/195,296

(22) Filed: Jul. 15, 2002

(65) Prior Publication Data

US 2004/0007099 A1 Jan. 15, 2004

(30) Foreign Application Priority Data

Apr. 22, 2002 (TW) ..... 91205629 U

(51) Int. Cl.[7] ..... B25B 13/46
(52) U.S. Cl. ..... 81/60; 192/41 R
(58) Field of Search ..... 81/60; 192/41 R, 192/45.1

(56) References Cited

U.S. PATENT DOCUMENTS

| | | | | |
|---|---|---|---|---|
| 5,979,274 A | * | 11/1999 | Hsieh | 81/60 |
| 6,382,051 B1 | * | 5/2002 | Chang | 81/60 |
| 6,539,825 B1 | * | 4/2003 | Lin | 81/60 |
| 6,591,717 B2 | * | 7/2003 | Wei | 81/60 |
| 2002/0162423 A1 | * | 11/2002 | Hu | 81/60 |

* cited by examiner

*Primary Examiner*—James G. Smith
(74) *Attorney, Agent, or Firm*—Alan D. Kamrath; Nikolai & Mersereau, P.A.

(57) ABSTRACT

A wrench includes a head, a gear, an engagement element and a bent spring. The head defines a circular space and a crescent space communicated with the circular space. The gear includes a plurality of teeth and is received in the circular space. The engagement element includes a concave face formed with a plurality of teeth and a convex face and is received in the crescent space. The teeth of the engagement element are engaged with some of the teeth of the gear. The convex face contacts a wall of the crescent space. The bent spring is received in the crescent space so that first a section of the spring contacts the wall of the crescent space and a second section of the spring contacts the engagement element. When the head is rotated in a first direction, the gear tends to rotate the engagement element relative to the head in a second position opposite to the first direction so as to enhance the engagement of the teeth so as to avoid rotation of the bead relative to the gear. When the head is rotated in the second direction, the gear rotates the engagement element in the first direction relative to the head since the convex face is not hindered via the wall of the crescent space, thus disengaging the teeth of the engagement element from the teeth of the gear, thus allowing rotation of the head relative to the gear.

19 Claims, 10 Drawing Sheets

ONE-WAY WRENCH

BACKGROUND OF INVENTION

1. Field of Invention

The present invention relates to a one-way wrench.

2. Related Prior Art

Taiwan Patent Publication No. 281946 teaches a one-way wrench including a head 10, an annular gear 20, an engagement block 13 and a spring 14. The head 10 defines a circular space 11 and a crescent space 111 communicated with the circular space 11. A wall of the crescent space 111 defines a recess 112. The annular gear 20 includes an external face formed with a plurality of teeth 23 and an internal face 24 for engagement wit a nut or a head of a bolt. The engagement block 13 includes a convex face formed with a boss 131 and a concave face formed with a plurality of teeth 132. The spring 14 includes an end receiving the boss 131. The engagement block 13 and the spring 14 are received in the crescent space 111. Normally, the teeth 132 are engaged with some of the teeth 23. The convex face contacts the wall of the crescent space 111. As the head 10 is rotated in a first direction, the annular gear 20 engaged with the nut or the head of the bolt tends to rotate the engagement block 13 in a second direction opposite to the first direction relative to the head 10, thus enhancing the contact of the convex face with the wall of the crescent space 111 and the engagement of the teeth 132 with the teeth 23. Thus, rotation in the first direction of the head 10 relative to the annular gear 20 is avoided. Therefore, the head 10 rotates the annular gear 20 in the first direction together with the nut or the head of the bolt clockwise. When the head 10 is rotated in the second direction, the annular gear 20 engaged with the nut or the head of the bolt is allowed to rotate the engagement block 13 in the first direction relative to the head 10 because the convex face is not hindered by means of the wall of the crescent space 111. Thus, the teeth 132 can be disengaged from the teeth 23 in order to allow rotation of the head 10 relative to the annular gear 20. Therefore, rotation of the head 10 in the second direction does not cause rotation of the annular gear 20 in the second direction together with the nut or the head of the bolt.

Taiwan Patent Publication No. 335750 teaches a one-way wrench including a head, an annular gear 35, an engagement block 40, a base 50 and a spring 60. The head defines a crescent space 31 and a circular space 32 and communicated with the crescent space 31. A wall of the crescent space 31 defines a recess 34. The annular gear 35 includes an internal face for engagement with a nut or a head of a bolt and an external face formed with a plurality of teeth 52. The engagement block 40 includes a plurality of teeth and a convex face and defines a recess. The base 50 defines a channel and includes a convex face and a boss 51 formed on the convex face. The spring 60 includes an end received in the recess defined in the engagement block 40 and an opposite end inserted in the channel defined in the base 50. The engagement block 40, the base 50 and the spring 60 are received in the crescent space 31. The boss 51 is received in the recess 34. The annular gear 35 is received in the circular space 32. Normally, the teeth of the engagement block 40 are engaged with some of the teeth of the annular gear 35. The convex faces contact the wall of the crescent space 31. As the head is rotated in a first direction, the annular gear 35 engaged with the nut or the head of the bolt tends to rotate the engagement block 40 in a second direction opposite to the first direction relative to the head, thus enhancing the contact of the convex face of the engagement block 40 with the wall of the crescent space 31 and the engagement of the teeth of the engagement block 40 with the teeth of the annular gear 35. Thus, rotation in the first direction of the head relative to the annular gear 35 is avoided. Therefore, the head rotates the annular gear 35 in the first direction together with the nut or the head of the bolt. When the head is rotated in the second direction, the annular gear 35 engaged with the nut or the head of the bolt is allowed to rotate the engagement block 40 in the first direction relative to the head because the convex face of the engagement block 40 is not hindered by means of the wall of the crescent space 31. Thus, the teeth of the engagement block 40 can be disengaged from the teeth of the annular gear 35 so as to allow rotation of the bead relative to the annular gear 35. Therefore, rotation of the head in the second direction does not cause rotation of the annular gear 35 in the second direction together with the nut or the head of the bolt. Fabrication and mounting the base 50 require effort and therefore increase its cost.

Taiwan Patent Publication No. 431260 teaches a one-way wrench including a head 20, an annular gear 50, an engagement block 30, a seesaw 40 and a spring 44. The head 20 defines a circular space 22 and a crescent space 23 communicated with the circular space 22. The annular gear 50 includes an internal face for engagement with a nut or a head of a bolt and an external face formed with a plurality of teeth 52. The engagement block 30 includes a plurality of teeth 32 and a convex face 34 and defines a recess 35. The seesaw 40 includes a convex face 41, two corners 42 and an end 43. The spring 44 includes an end fit in the recess 35 and an opposite end in which the end 43 of the seesaw 40 is fit. The engagement block 30, the seesaw 40 and the spring 44 are movably received in the crescent space 23. The annular gear 50 is received in the circular space 22. When the head 20 is rotated in a first direction, the annular gear 50 contacts one of the corners 42, thus pivoting the engagement block 30 to the annular gear 50. Thus, the teeth 32 are engaged with some of the teeth 52 so that the annular gear 50 engaged with the nut or the head of the bolt tends to rotate the engagement block 30 in a second direction opposite to the first direction relative to the head 10, thus enhancing the contact of the convex face 34 with the wall 24 and the engagement of the teeth 32 with the teeth 52. Therefore, rotation in the first direction of the head 20 relative to the annular gear 50 is avoided. The head 20 rotates the annular gear 50 in the first direction together with the nut or the head of the bolt. When the head 20 is rotated in the second direction, the annular gear 50 contacts both the corners 42 so as to pivot the engagement block 30 from the annular gear 50. Thus, the teeth 32 are disengaged from the teeth 52 so as to allow rotation of the head 20 relative to the annular gear 50. Therefore, rotation of the head 20 in the second direction does not cause rotation of the annular gear 50 in the second direction together with the nut or the head of the bolt. The engagement block 30 may not be engaged with or disengaged from the annular gear 50 as desired since the engagement block 30, the seesaw 40 and the spring 44 can slide together in the crescent space 23. Moreover, fabrication and installment of the seesaw 40 requires effort and therefore increase its cost.

The present invention is therefore intended to obviate or at least alleviate the problems encountered in prior art.

SUMMARY OF INVENTION

It is the primary objective of the present invention to provide a one-way wrench that is simple in structure and low in cost.

According to the present invention, a one-way wrench includes a head, a gear, an engagement element and a bent spring. The head defines a circular space and a crescent space communicated with the circular space. The gear includes a plurality of teeth, and is received in the circular space. The engagement element includes a concave face formed with a plurality of teeth and a convex face, and is received in the crescent space. The teeth of the engagement element are engaged with some of the teeth of the gear. The convex face contacts a wall of the crescent space. The bent spring includes first and second sections, and is received in the crescent space so that the first section of the spring contacts the wall of the crescent space and the second section of the spring contacts the engagement element. When the head is rotated in a first direction, the gear tends to rotate the engagement element relative to the head in a second direction opposite to the first direction so as to enhance the engagement of the teeth so as to avoid rotation of the head relative to the gear. When the head is rotated in the second direction, the gear rotates the engagement element in the first direction relative to the head since the convex face is not hindered via the wall of the crescent space, thus disengaging the teeth of the engagement element from the teeth of the gear so as to allow rotation of the head relative to the gear.

Other objectives and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENTS

Figure 1:
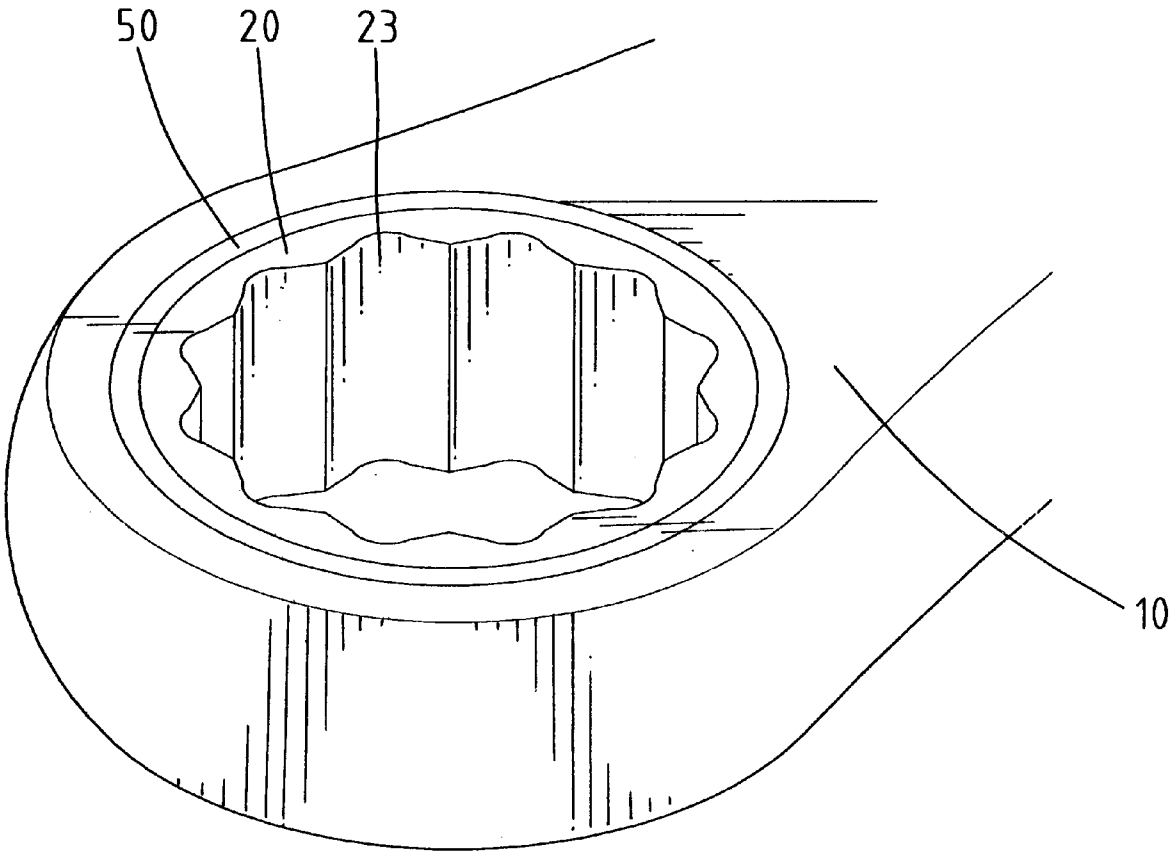
FIG. 1 is a perspective view of a one-way wrench according to a first embodiment of the present invention.
Figure 2:
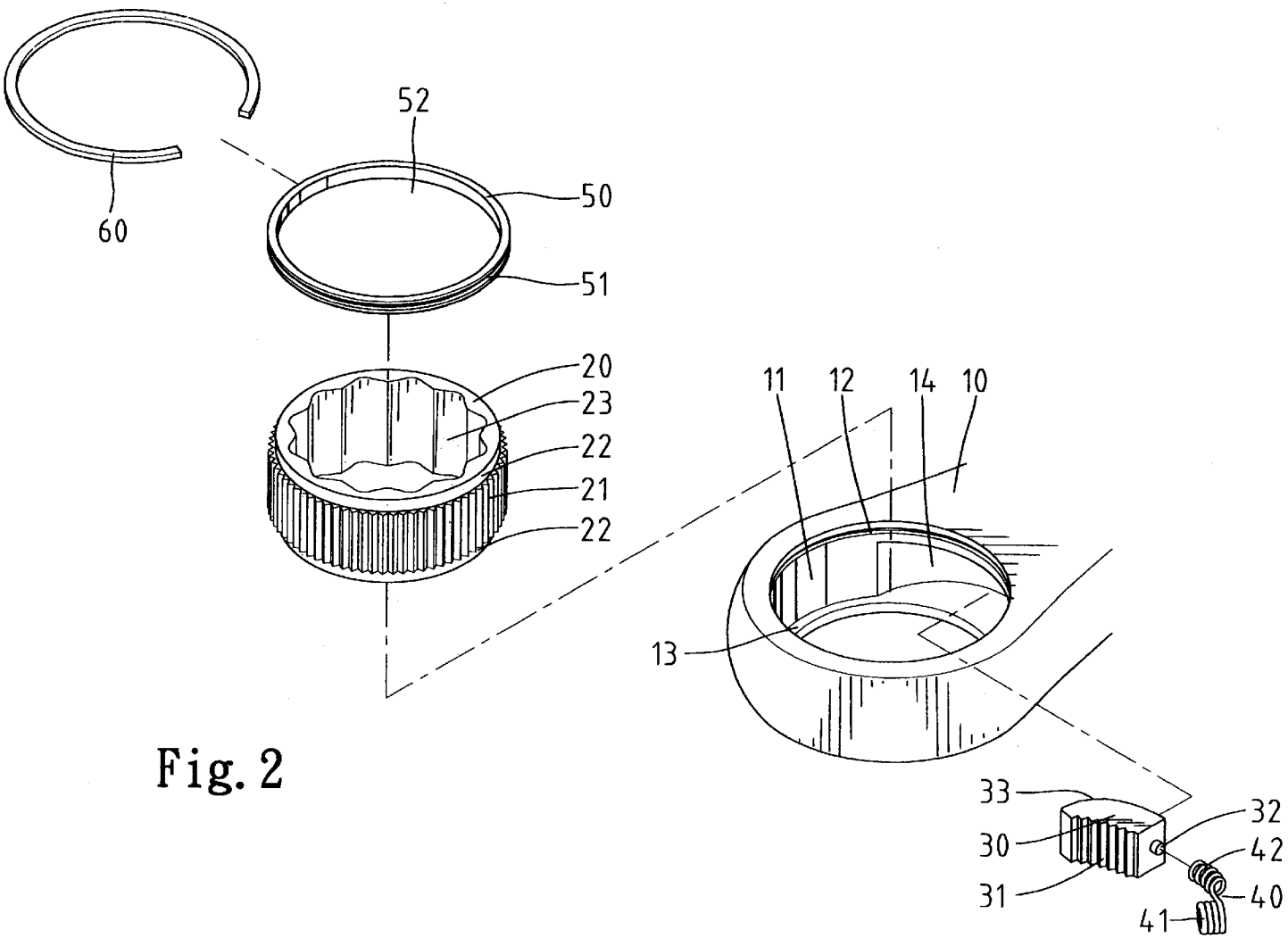
FIG. 2 is an exploded view of the one-way wrench according to the first embodiment of the present invention.

FIGS. 1–4 show a one-way wrench according to a first embodiment of the present invention. The wrench includes a head 10, an annular gear 20, an engagement element 30, a spring 40, an O-ring 50 and a C-ring 60.

The head 10 defines a circular space 11 and a crescent space 14 communicate with the circular space 11. A groove 12 is defined in a wall of the circular space 11 near an upper face of the head 10. A rim 13 is formed on the wall of the circular space 11 at a lower face of the head 10.

The annular gear 20 includes an external face formed with a plurality of teeth 21 and upper and lower shanks 22 and an internal face 23 for engagement with a nut or a head of a bolt.

The engagement element 30 includes a plurality of teeth 31 formed on a first face, a boss 32 formed on a second face next to the first face and a convex face 33.

The spring 40 includes a bent configuration consisting of a first helical section 41 and a second helical section 42. An axis of the first helical section 41 of the spring 40 and an axis of the second helical section 42 of the spring 40 lie in a same plane. The first helical section 41 includes a free end 411 and a periphery 412.

The O-ring 50 defines a groove 51 in an external face and a circular hole 52.

In assembly, the boss 32 is forced into the second helical section 42 of the spring 40. The engagement element 30 and the spring 40 are received in the crescent space 14. The annular gear 20 is received in the circular space 11. The lower shank 22 is positioned within the rim 13. The lower shank 22 acts as a shaft, and the rim 13 acts as a bearing. The free end 411 of the first helical section 41 of the spring 40 contacts the annular gear 20. The C-ring 60 is expended so that an internal edge thereof can be received in the groove 51. Then, the C-ring 60 is pressed into the groove 51 so tat the O-ring 50 and the C-ring 60 can be mounted onto the upper shank 22 and into the circular space 11. On alignment with the groove 12, an external edge of the C-ring 60 snaps into the groove 12. The internal edge of the C-ring 60 remains in the groove 51. Thus, the O-ring 50 is retained onto head 10 by means of the C-ring 60. The upper shank 22 acts as a shalt, and the O-ring 50 acts as bearing.

Figure 3:
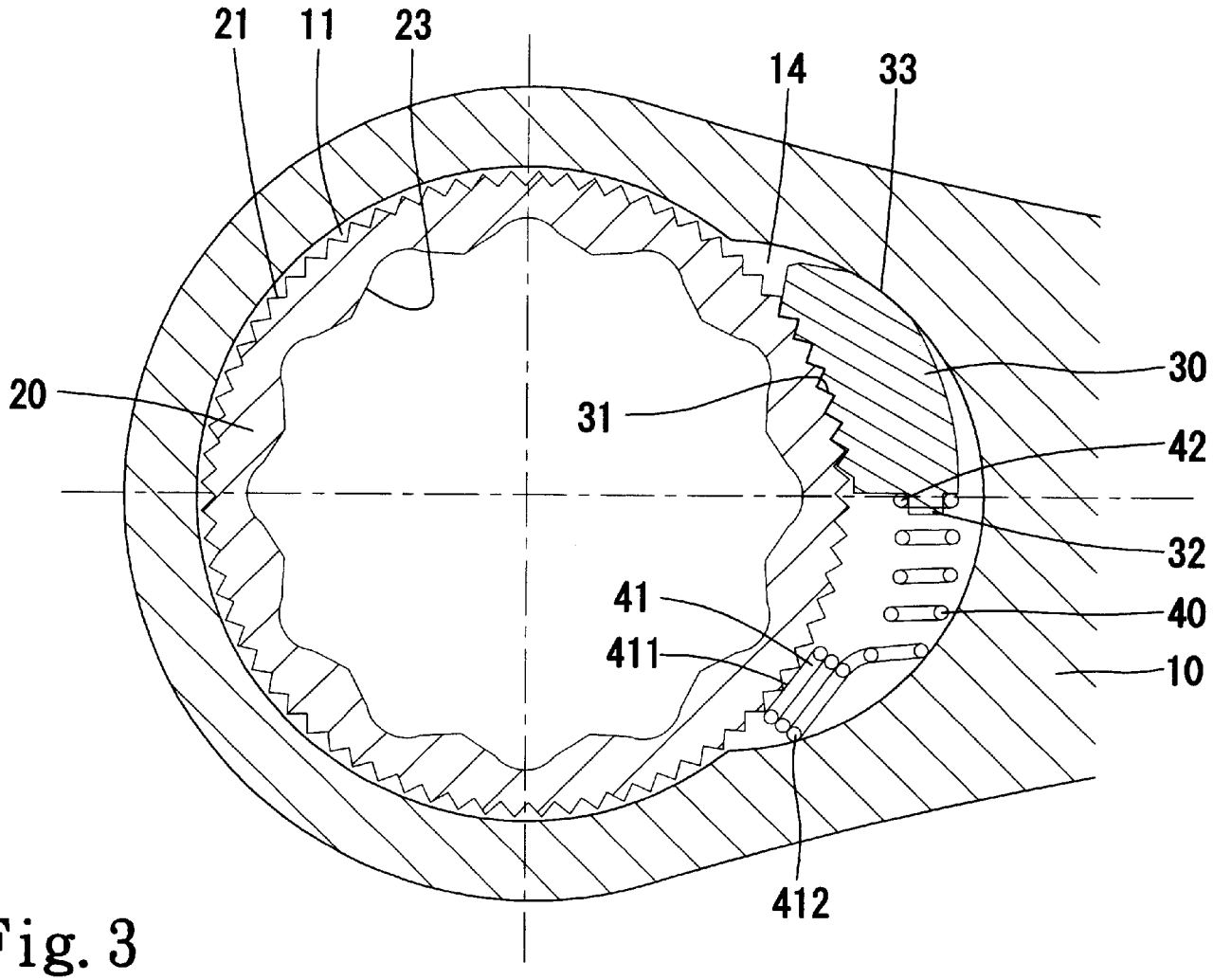
FIG. 3 is a cross-sectional view of the one-way wrench in a driving mode according to the first embodiment of the present invention.

Referring to FIG. 3, the teeth 31 of the engagement element 30 are engaged with some of the teeth 21 of the annular gear 20. The convex face 33 is in contact with a wall of the crescent space 14. Although not shown, a nut or a head of a bolt is engaged with the annular gear 20. When the head 10 is rotated clockwise, the annular gear 20 engaged wit the nut or the head of the bolt tends to rotate the engagement element 30 counterclockwise relative to the head 10. This tendency enhances the contact of the convex face 33 with the wall of the crescent space 14 and the engagement of the teeth 31 with the teeth 21. Thus, this tendency is hindered and clockwise rotation of to head 10 relative to the annular gear 20 is avoided. Therefore, the head 10 rotates the annular gear 20 clockwise together with the nut or the head of the bolt.

Figure 4:
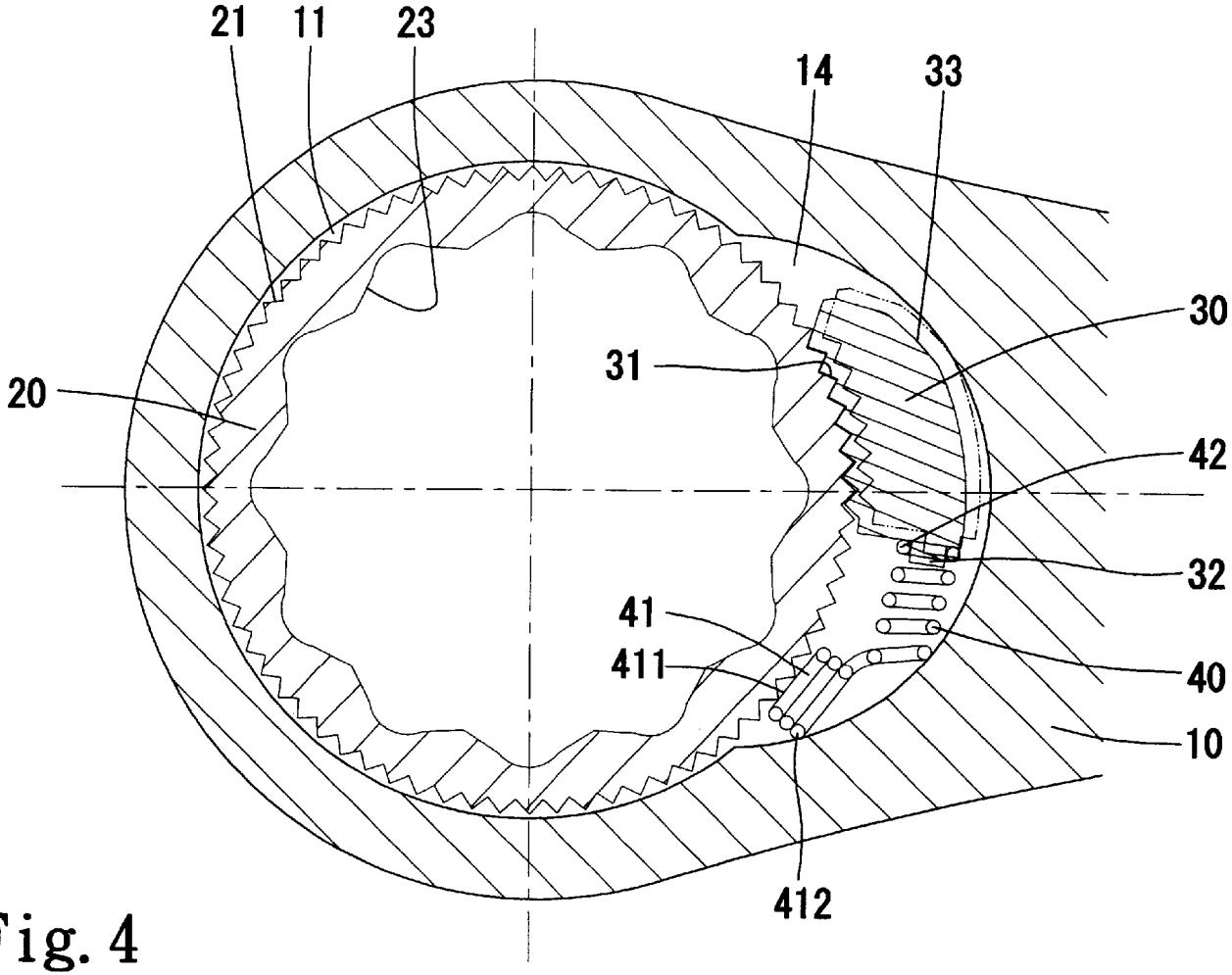
FIG. 4 is a cross-sectional view of the one-way wrench in an idle mode according to the first embodiment of the present invention.

In FIG. 4, when the head 10 is rotated counterclockwise, the annular gear 20 engaged with the nut or the head of the bolt rotates the engagement element 30 clockwise relative to the head 10 because the convex face 33 is not hindered by means of the wall of the crescent space 14. Thus, the teeth 31 can be disengaged from the teeth 21 so as to allow counterclockwise rotation of the head 10 relative to the annular gear 20. Therefore, counterclockwise rotation of the head 10 does not cause counterclockwise rotation of the annular gear 20 together with the nut or the head of the bolt clockwise. The annular gear 20 retains the fast helical section 41 of the spring 40 in contact with to wall of the crescent space 14. Therefore, when the head 10 is released, the spring 40 returns the engagement element 30 into engagement with to annular gear 20.

Figure 5:
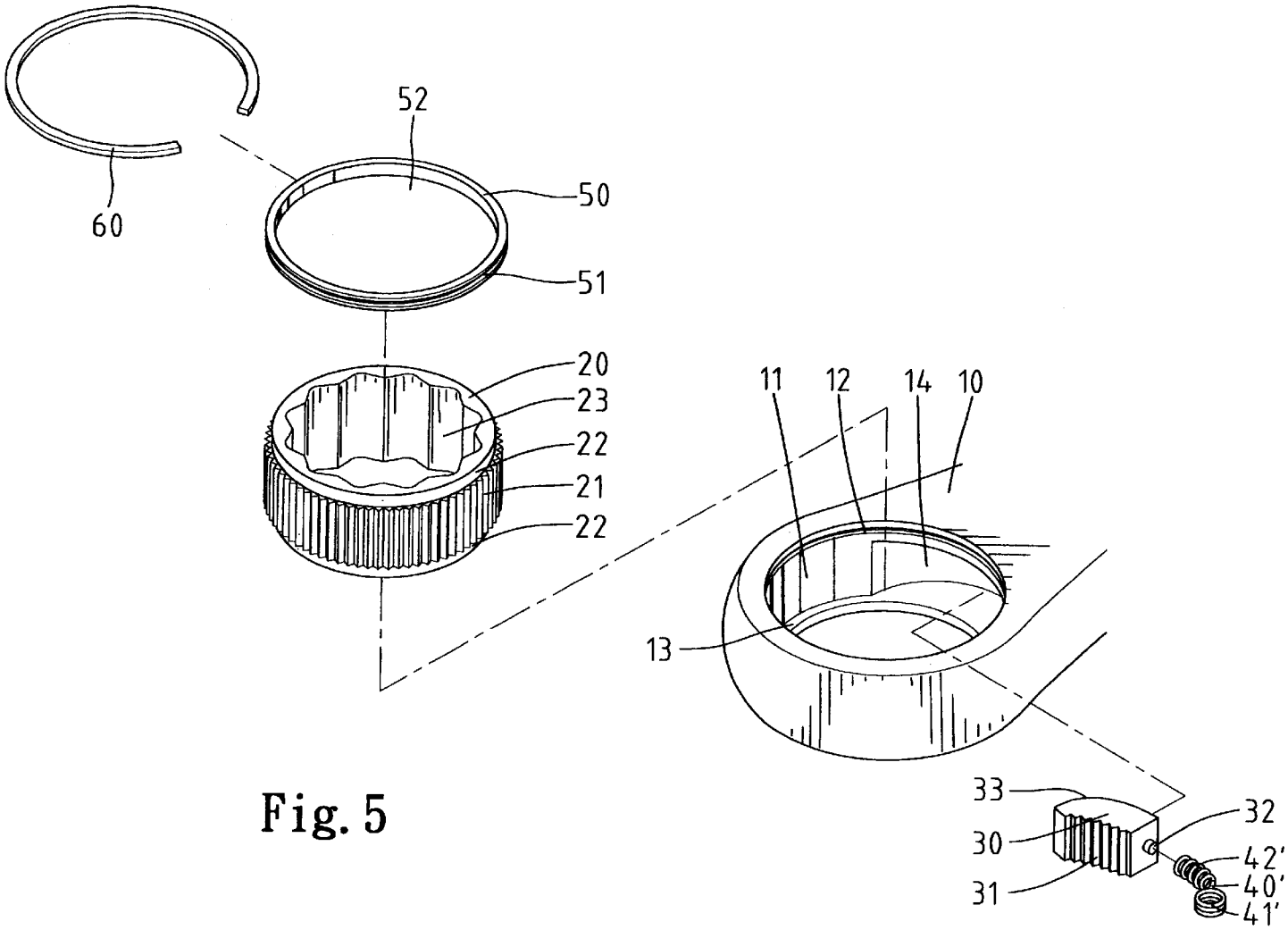
FIG. 5 is an exploded view of a one-way wrench according to a second embodiment of the present invention.
Figure 6:
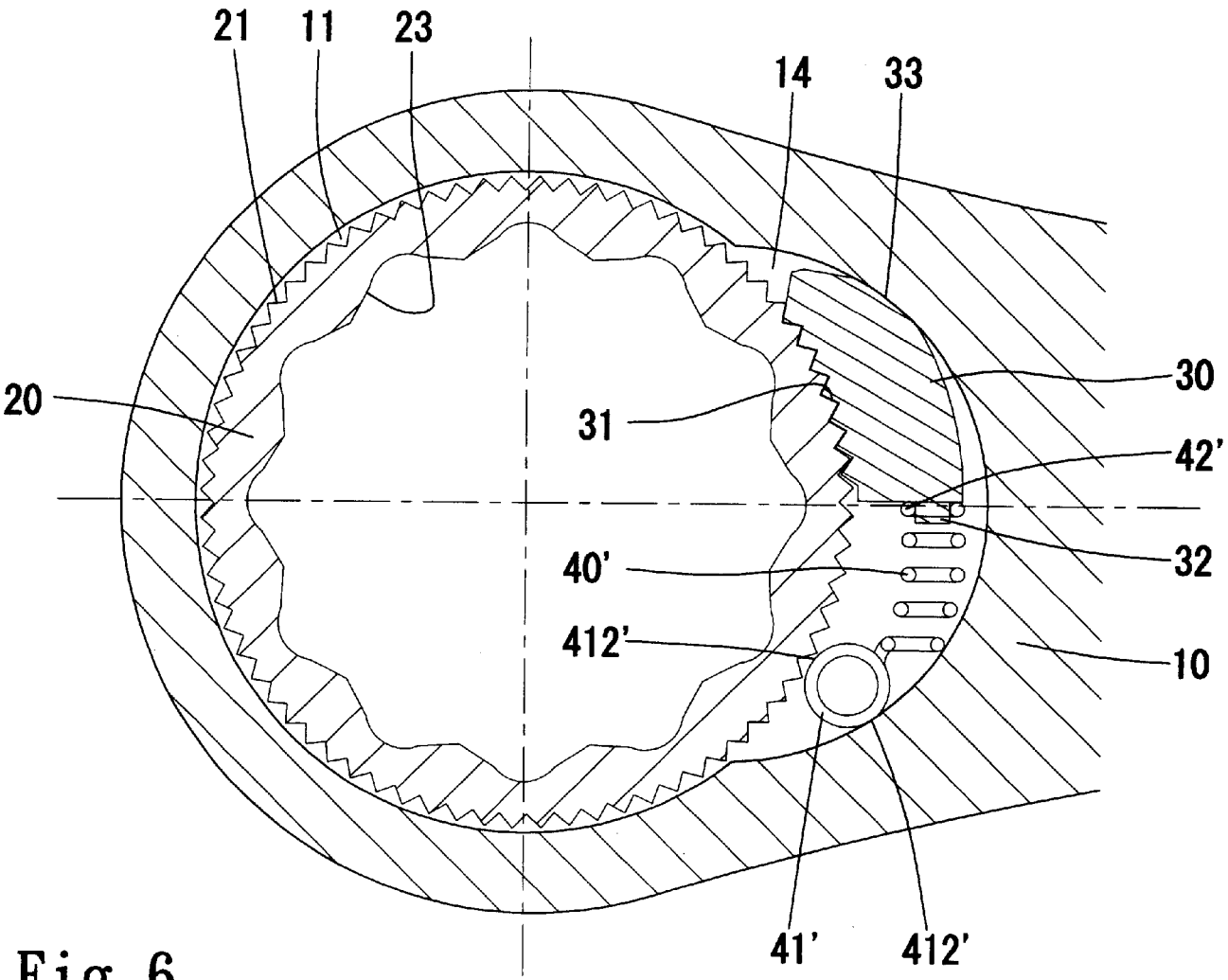
FIG. 6 is a cross-sectional view of the one-way wrench in a driving mode according to the second embodiment of the present invention.
Figure 7:
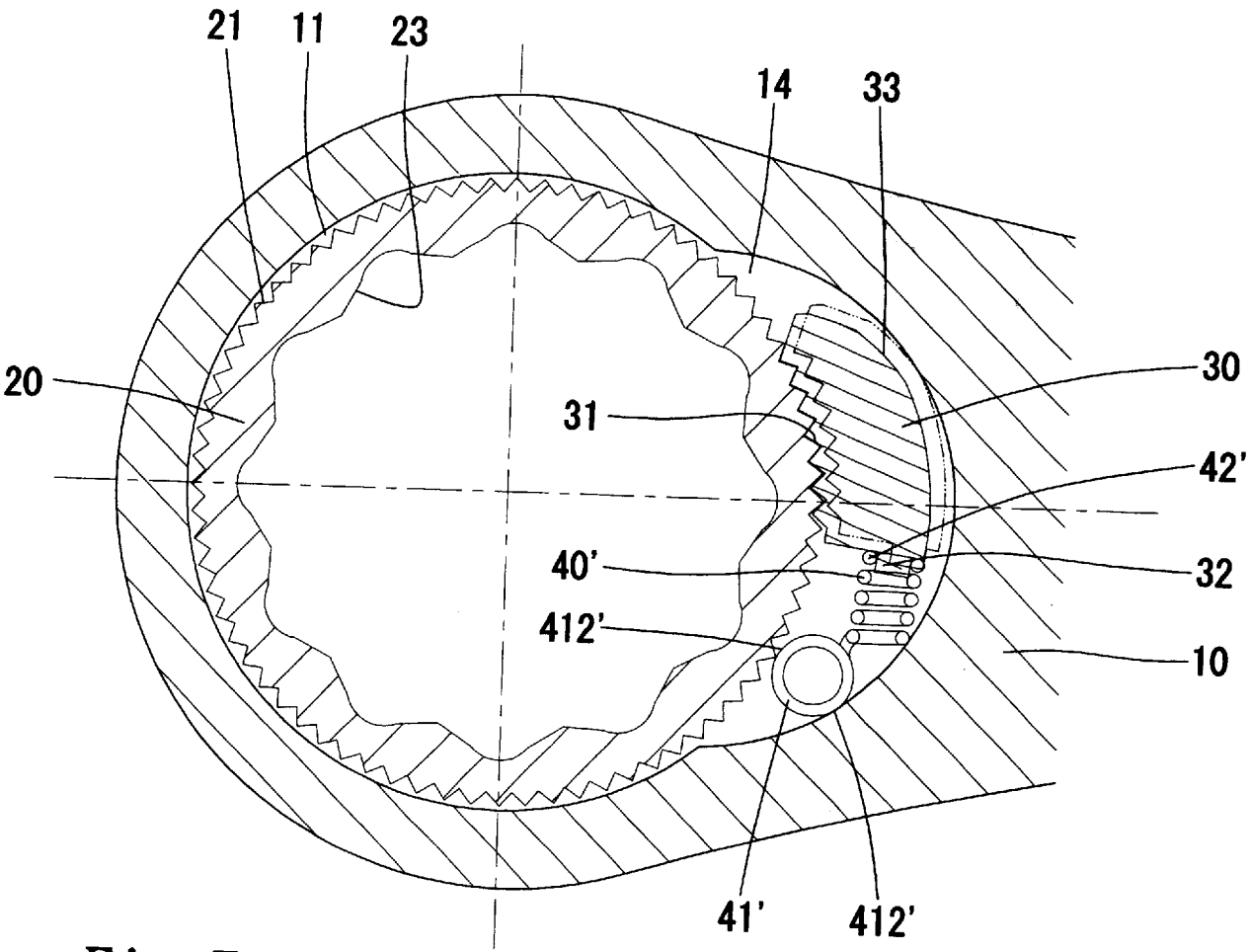
FIG. 7 is a cross-sectional view of the one-way wrench in an idle mode according to the second embodiment of the present invention.

FIGS. 5 and 6 show a one-way wrench according to a second embodiment of the present invention. The second embodiment is identical to the first embodiment except for including a spring 40' instead of the spring 40. Like the spring 40, the spring 40' includes a bent configuration consisting of a first helical section 41' and a second helical section 42'. However, an axis of the first helical section 41' of the spring 40' and an axis of the second helical section 42' of the spring 40' do not lie in a same plane. The first helical section 41' of the spring 40' includes a free end 411' and a periphery 412'. As best shown in FIGS. 6 and 7, when the spring 40' is received in the crescent space 14, the periphery 412' of the first helical section 41' of the spring 40' contacts the wall of the crescent space 14 and some of the teeth 21. The teeth 21 will not he trapped in the first helical section 41' of the spring 40'. Such trapping will hinder counterclockwise rotation of the head 10 relative to the annular gear 20 and is not desirable.

Figure 8:
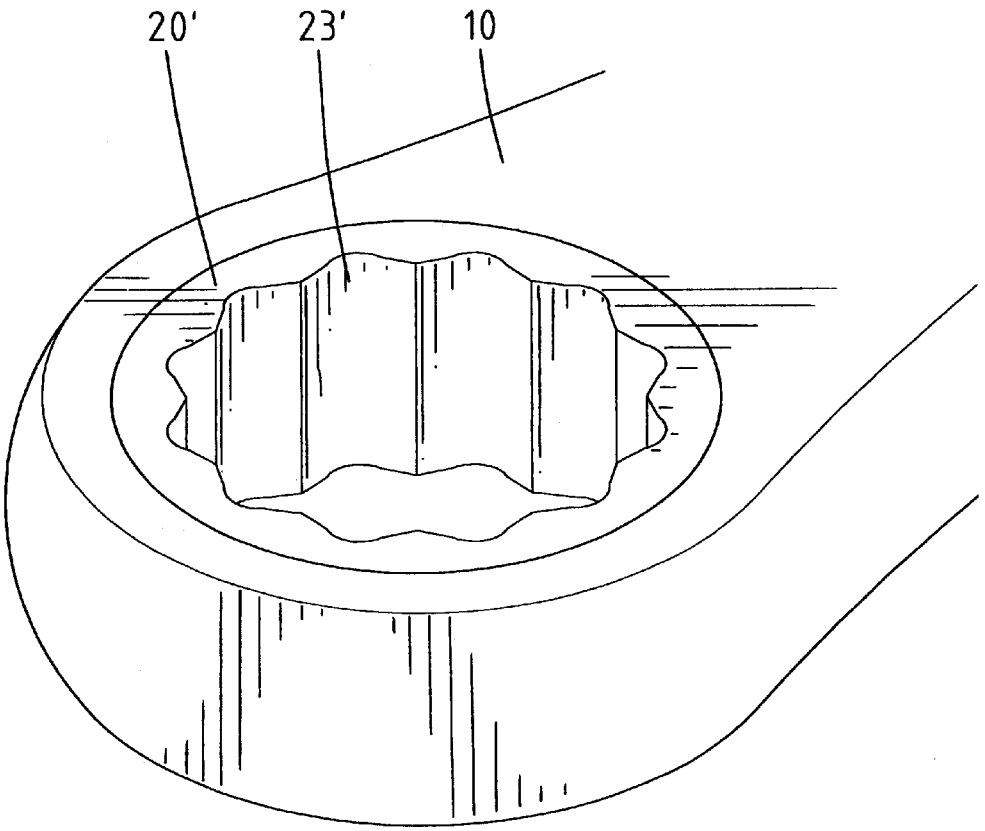
FIG. 8 is a perspective view of a one-way wrench according to a third embodiment of the present invention.
Figure 9:
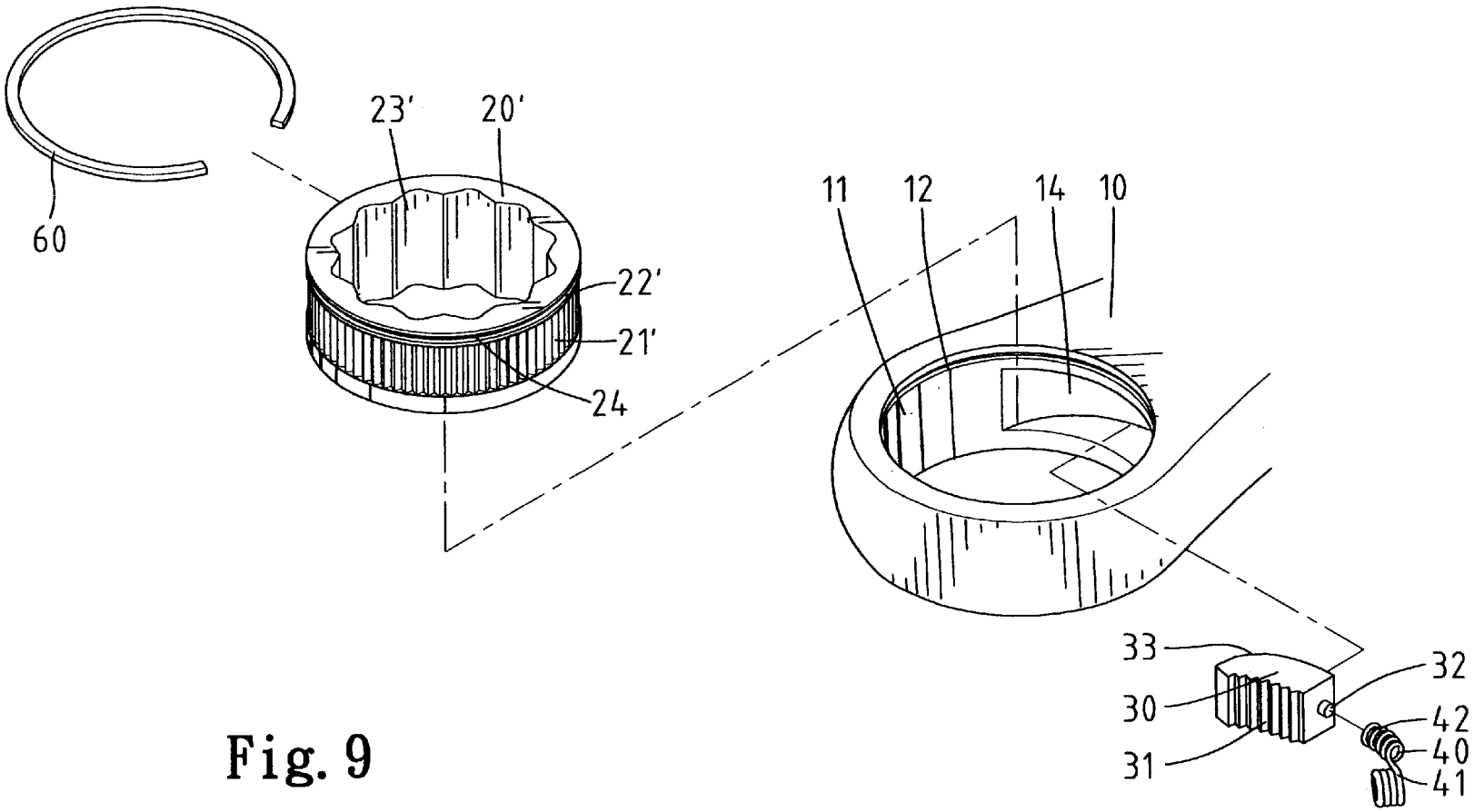
FIG. 9 is an exploded view of the one-way wrench according to the third embodiment of the present invention.

FIGS. 8 and 9 show a one-way wrench according to a third embodiment of the present invention. The third embodiment is identical to the first embodiment except for including an annular gear 20' instead of the annular gear 20 and not including an O-ring such as the O-ring 50 and not including a rim such as the rim 13. The annular gear 20' has an internal face 23' and is identical to the annular gear 20 except for including an upper shank 22' defining a groove 24. In the third embodiment, the C-ring 60 is received in the groove 24 like it is A rotational connection of the head 10 of the annular gear 20' is made possible. Therefore, a rim such as the rim 13 is no longer necessary to support the annular gear 20'.

Figure 10:
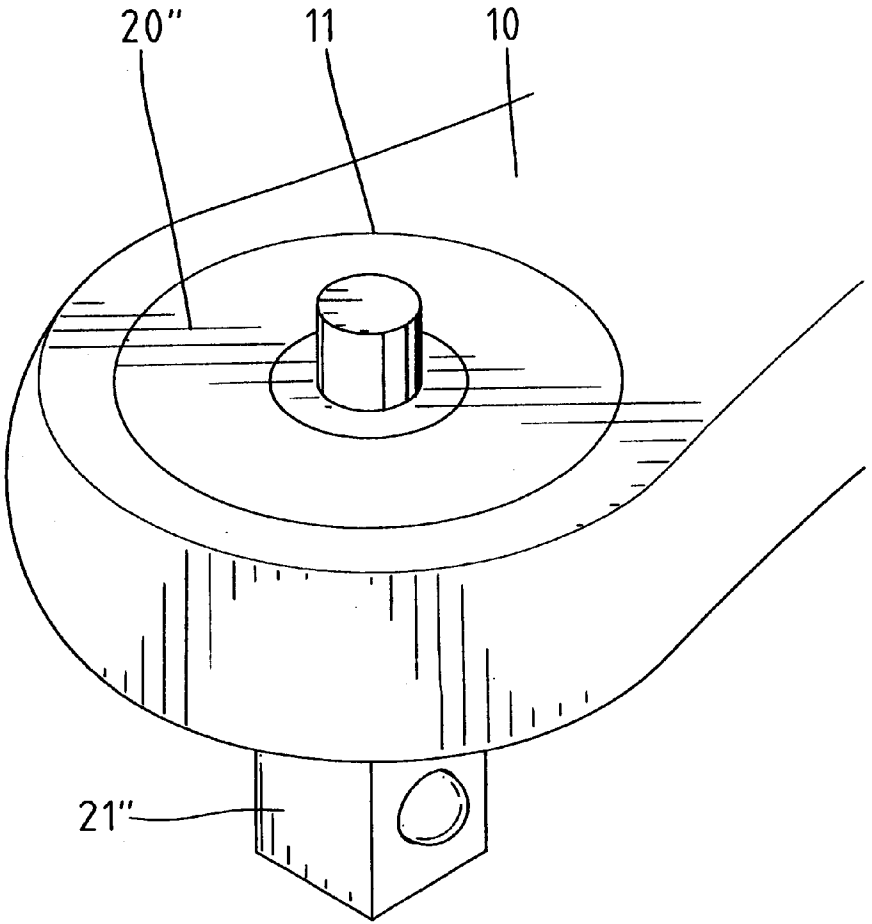
FIG. 10 is a perspective view of a one-way wrench according to a fourth embodiment of the present invention.

FIG. 10 shows a one-way wrench according to a fourth embodiment of the present invention. The fourth embodiment is identical to the first embodiment except for including an annular gear 20" instead of the annular gear 20. The annular gear 20" is engaged with a mandrel 21" which in turn can be engaged with a socket for driving a nut or a head of a bolt.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A wrench including a head defining a circular space and a crescent space communicated with the circular space, a gear including a plurality of teeth and being received in the circular space, an engagement element including a concave face formed with a plurality of teeth and a convex face and being received in the crescent space so that the teeth of the engagement element are engaged with some of the teeth of the gear and that the convex face contacts a wall of the crescent space an elastic element including a first section and a second section, with the elastic element being a spring, with the first and second sections of the elastic element being helical, with the elastic element being received in the crescent space so that the first section of the elastic element contacts the wall of the crescent space, that the first section of the elastic element includes a free end in contact with the gear and that the second section of the elastic element contacts the engagement element, wherein:

when the head is rotated in a first direction, the gear tends to rotate the engagement element relative to the head in a second direction opposite to the first direction so as to enhance the engagement of the teeth so as to avoid rotation of the head relative to the gear; and when the head is rotated in the second direction, the gear rotates the engagement element relative to the head in the first direction since the convex face is not hindered via the wall of the crescent space, thus disengaging the teeth of the engagement element from the teeth of the gear so as to allow rotation of the head relative to the gear.

2. The wrench according to claim 1, wherein the elastic element is bent.

3. The wrench according to claim 1 wherein the head includes a groove defined in the wall of the circular space, and the gear includes a shank formed on the external face, and the wrench includes an O-ring defining a groove in an external face and being mounted on the shank of the gear and a C-ring including an external edge received in the groove defined in head and an internal edge received in the groove defined in the O-ring.

4. The wrench according to claim 1 wherein the head includes a rim formed on the wall of the circular space for supporting the gear.

5. The wrench according to claim 8 wherein the gear includes a shank formed on the external face, the shank of the gear being positioned within the rim.

6. The wrench according to claim 1 wherein the gear is an annular gear.

7. The wrench according to claim 1 wherein the gear includes a mandrel for engagement with a socket.

8. The wrench according to claim 1 wherein the head defines a groove in the wall of the circular space, and the gear defines a groove, and the wrench includes a C-ring including an external edge received in the groove defined in head and an internal edge received in the groove denied in the gear.

9. A wrench including a head defining a circular space and a crescent space communicated with the circular space, a gear including a plurality of teeth and being received in the circular space, an engagement element including a concave face formed with a plurality of teeth and a convex face and being received in the crescent space so that the teeth of the engagement element are engaged with some of the teeth of the gear and that the convex face contacts a wall of the crescent space, a spring including a first section and a second section and being received in the crescent space so that the first section of the spring contacts the wall of the crescent space and that the second section of the spring contacts the engagement element, wherein:

when the head is rotated in a first direction, the gear tends to rotate the engagement element relative to the head in a second direction opposite to the first direction so as to enhance the engagement of the teeth so as to avoid rotation of the head relative to the gear;

when the bead is rotated in the second direction, the gear rotates the engagement element relative to the head in the first direction since the convex face is not hindered via the wall of the crescent space, thus disengaging the teeth of the engagement element from the teeth of the gear so as to allow rotation of the head relative to the gear;

wherein the first and second sections of the spring are helical; and wherein the first helical section of the spring includes a periphery in contact with the gear.

10. The wrench according to claim 9 wherein the spring is bent.

11. The wrench according to claim 9 wherein the head includes a groove defined in the wall of the circular space, and the gear includes a shank formed on the external face, an the wrench includes an O-ring defining a groove in an external face and being mounted on the shank of the gear and a C-ring including an external edge received in the groove defined in head and an internal edge received in the groove defined in the O-ring.

12. The wrench according to claim 9 wherein the head includes a rim formed the wall of the circular space for supporting the gear.

13. The wrench according to claim 12 wherein the gear includes a shank formed on the external face, the shank of the gear being positioned within the rim.

14. The wrench according to claim 9 wherein the gear is an annular gear.

15. A wrench including a head defining a circular space and a crescent space communicated with the circular space, a gear including a plurality of teeth and being received in the circular space, an engagement element including a concave face formed with a plurality of teeth and a convex face and being received in the crescent space so that the teeth of the engagement element are engaged with some of the teeth of the gear and that the convex face contacts a wall of the crescent space, a bent spring including a first section and a second section and being received in the crescent space so that the first section of the bent spring contacts the wall of the crescent space and that the second section of the bent spring contacts the engagement element, wherein:

when the bead is rotated in a first direction, the gear tends to rotate the engagement element relative to the head in a second direction opposite to the first direction so as to enhance the engagement of the teeth so as to avoid rotation of the head relative to the gear;

when the head is rotated in the second direction, the gear rotates the engagement element relative to the head in the first direction since the convex face is not hindered via the wall of the crescent space, thus disengaging the teeth of the engagement element from the teeth of the gear so as to allow rotation of the head relative to the gear;

wherein the first and second sections of the bent spring are helical; and wherein the engagement element includes a boss formed thereon for insertion in the second helical section of the bent spring.

16. The wrench according to claim 15 wherein the first helical section of the bent spring includes a free end in contact with the gear.

17. The wrench according to claim 15 wherein the first helical section of the bent spring includes a periphery in contact with the gear.

18. The wrench according to claim 15 wherein the head includes a rim formed on the wall of the circular space for supporting the gear.

19. The wrench according to claim 15 wherein the gear is an annular gear.

* * * * *